US007137533B1

(12) United States Patent
Heath

(10) Patent No.: US 7,137,533 B1
(45) Date of Patent: Nov. 21, 2006

(54) BEVERAGE DISPENSING SYSTEM

(76) Inventor: Jennifer Heath, 3341 Hackmatack Dr., Kennesaw, GA (US) 30152

( * ) Notice: Subject to any disclaimer, the term of this patent is extended or adjusted under 35 U.S.C. 154(b) by 0 days.

(21) Appl. No.: 11/249,944

(22) Filed: Oct. 13, 2005

(51) Int. Cl.
*B67D 5/64* (2006.01)

(52) U.S. Cl. ..... 222/166; 222/183; 248/133

(58) Field of Classification Search ..... 222/183, 222/185.1, 166; 248/133
See application file for complete search history.

(56) References Cited

U.S. PATENT DOCUMENTS

| | | | | | |
|---|---|---|---|---|---|
| 150,082 | A | * | 4/1874 | Reif | 222/166 |
| 1,268,867 | A | * | 6/1918 | Mojonnier | 248/133 |
| 3,082,927 | A | | 3/1963 | Winstead | |
| 3,368,741 | A | * | 2/1968 | Mercur | 229/70 |
| 3,696,969 | A | | 10/1972 | De Van et al. | |
| 3,747,809 | A | * | 7/1973 | Harvey et al. | 222/183 |
| 4,105,139 | A | | 8/1978 | Scholle | |
| 4,120,426 | A | * | 10/1978 | Grubbs | 222/183 |
| 4,524,883 | A | | 6/1985 | Herring | |
| 4,679,242 | A | | 7/1987 | Brockhaus | |
| 4,812,054 | A | | 3/1989 | Kirkendall | |
| 4,907,723 | A | * | 3/1990 | Katz | 222/185.1 |
| 4,927,042 | A | | 5/1990 | Ring | |
| 5,074,429 | A | | 12/1991 | Konkel et al. | |
| 5,535,883 | A | | 7/1996 | Henderson | |
| 6,334,329 | B1 | | 1/2002 | Weller | |
| 6,554,164 | B1 | * | 4/2003 | Jones | 222/166 |
| 6,595,475 | B1 | | 7/2003 | Svabek et al. | |

* cited by examiner

*Primary Examiner*—Philippe Derakshani
(74) *Attorney, Agent, or Firm*—William H. Hollimon

(57) ABSTRACT

A beverage dispensing system provides for the secure, and aesthetically appealing, dispensing of beverages from beverage filled containers. The beverage dispensing system includes a housing adapted to receive a beverage filled container, a retractable stand for raising the rear of the housing to encourage complete dispensing of beverage, a labeling system to identify the contents of the beverage filled container, and aesthetically appealing ornamentation.

2 Claims, 2 Drawing Sheets

BEVERAGE DISPENSING SYSTEM

BACKGROUND OF THE INVENTION

The present invention pertains to beverage dispensing systems. In particular, the present invention regards a dispensing container comprising an outer enclosure which houses a fluid filled inner container.

Beverages, in particular many varieties of wine, are often stored and dispensed in containers that hold a greater volume of liquid than normally accommodated in bottles. These containers are often cube-shaped to maximize volumetric efficiency and to reduce the storage, handling, and other complications that arise in conjunction with managing multiple bottles. These containers are typically constructed of paper or fiberboard that has been treated to be watertight, and include a tap or spigot to allow the included beverage to be dispensed on demand.

However, these large volume containers have a number of inherent disadvantages. While these containers are functional, they are not attractive and often are associated with poor quality beverages even when the beverage contained is of a high quality. These containers are usually aesthetically unappealing, do not provide container puncture protection, do not provide insulating functionality, are often perceived as associated with a low quality product, and lack an efficient mechanism to allow complete emptying of the container.

There are many prior designs of beverage storage systems. However, none fully address the problems outlined above, nor provide an adequate solution.

SUMMARY OF THE INVENTION

The present invention is a beverage dispensing system that provides a protective enclosure for bulk beverage containers that is aesthetically appealing, provides insulating functionality, provides protection from puncture, and incorporates a system for positive displacement of all included liquid.

The inventive beverage dispensing system of the present invention preferably includes an outer housing comprised of a top surface, bottom surface, a front surface, a rear surface, and two side surfaces that create an enclosure. The top, bottom, front, rear, and side surfaces are preferably integrally formed from a molded plastic material that also provides insulating properties. The top surface is also preferably formed from a similar molded plastic material and is hinged or otherwise removable to allow for the placement of a beverage filled container into the enclosure. The housing includes means to securely fix the top surface in place once a beverage filled container has been positioned within the enclosure and a handle for transporting the housing. The front surface includes an opening for receiving a spout included on the beverage filled container, such that the included beverage is dispensable through the front surface of the housing. This opening is sized to accommodate a variety of spout designs, and the front surface further includes means for securing a spout into dispensing position. The front surface also includes means for removably attaching a label identifying the type of beverage contained within the housing. Alternatively, the housing may be constructed from wood or metal and include a layer of insulating material on the interior side of the housing.

The bottom surface of the housing includes a recessed, retractable stand that is positioned towards the rear of the bottom surface. When deployed, this stand raises the rear of the housing (with respect to the front of the housing) such that all of the included beverage may be easily dispensed through the spout exiting the front of the enclosure. When not deployed, the stand is recessed into the bottom surface such that the enclosure is level and the stand does not bear upon a receiving surface upon which the enclosure is placed. The top, rear, and side surfaces are designed to receive decorative treatments that may be permanently or removably attached thereto.

In use, the top surface of the housing is positioned to allow insertion of a beverage container into the interior of the enclosure. The dispensing spout of the beverage container is placed through the opening in the front surface of the housing and secured in place. The top surface is then returned to its secured position, fully enclosing the beverage container. An appropriate beverage identification label may be affixed to the front surface of the housing, and beverage dispensing may begin. As the beverage container empties, the stand may be retracted from the bottom surface of the housing to lift the rear of the housing and encourage efficient removal of all liquid in the beverage container.

Other aspects and advantages of the invention are illustrated and made apparent by the following discussion and accompanying figures of exemplary embodiments.

DESCRIPTION OF THE PREFERRED EMBODIMENTS

Figure 1:
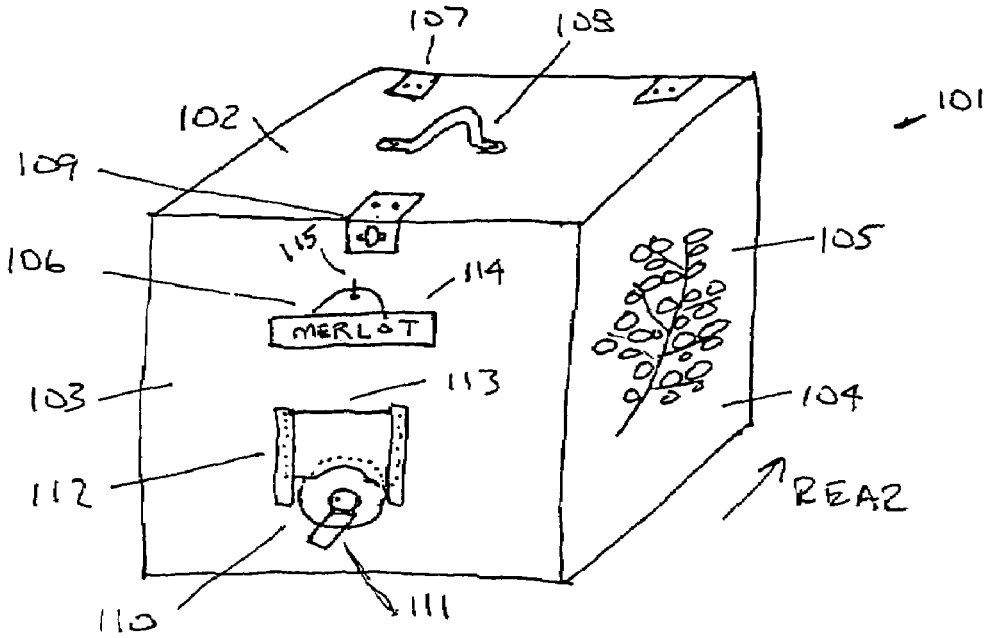
FIG. 1 is a perspective view of a preferred embodiment of the invention.
Figure 4:
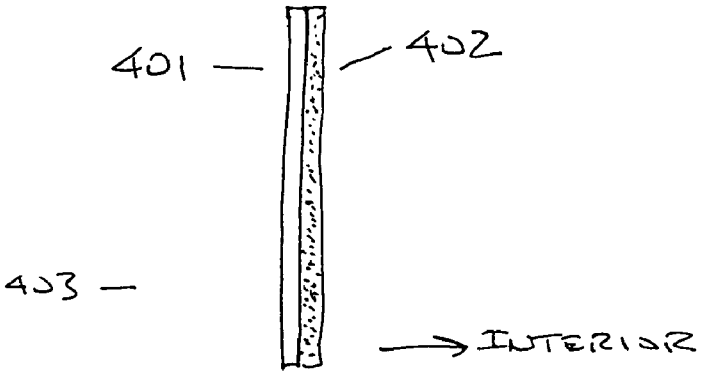
FIG. 4 is a cross sectional view of a rear surface of the present invention.

Referring to FIG. 1, an isometric view of an embodiment of the present invention is shown. Housing 101 is comprised of a top surface 102, two side surfaces 104, a front surface 103, and a bottom surface (not shown) and a rear surface (not shown) which form a complete enclosure into which a beverage filled container (not shown) may be positioned. Preferably, housing 101 is integrally formed from a molded plastic material that provides both structural rigidity and insulating properties. Alternatively, housing 101 may be constructed from wood or metal and, as shown in FIG. 4 (a cross section of rear surface 403), include a insulating material 402, that is laminated to exterior section 401 of rear surface 403.

Top surface 102 is hingedly connected to the housing rear surface via hinges 107. Alternatively, top surface 102 may use sliding or pinned connections that allow selective access to the interior of housing 101. Clasp 109 is a typical quarter-turn latch and slot system that allows top surface 102 to be positively secured in a closed position. Alternative systems for selectively securing top surface 102 to housing 101 are well known in the art and may be readily substituted. Handle 108 allows for easy movement of top surface 102 when clasp 109 is not secured, and allows for easy movement of housing 101 when clasp 109 is in its secured position. Alternatively, handle 108 may be integral to top 102 by, for example, consisting of one or more recessed grooves in top surface 102 that are configured to provide a hand-hold in top surface 102.

Front surface 103 includes content identification system 106, which includes a label 114 which is removably attached to hook 115. Alternate systems for removably labeling the contents of housing 101 are well know in the art and may be readily substituted. These include magnetic systems, temporary adhesives, hook and loop fasteners, and the like. Content identification system 106 allows for the easy identification of the beverage included in housing 101 and is easily changeable to accommodate the inclusion of multiple types of beverages in housing 101. Front surface 103 includes opening 110 which communicates with the interior of housing 101 and through which spout 111 of a beverage filled container (not shown) is disposed. Opening 110 is sized to accommodate a variety of spout designs utilized by the manufacturers of beverage filled containers. Slide 113 is slidably engaged between guides 112 and is positionable to secure spout 111 in position and to occlude or limit viewing into the interior of housing 101. Alternatively, slide 113 may be positioned interior to said housing, adjacent to front surface 103, or may be hingedly connected to front surface 103.

Side surfaces 104 are adapted to receive design 105. The rear surface (not shown) of housing 101 as well as top surface 102 and front surface 103 may also be adapted to receive design 105. Design 105 may be a permanent or removable ornamentation that increases the aesthetic appeal of housing 101.

Figure 2:
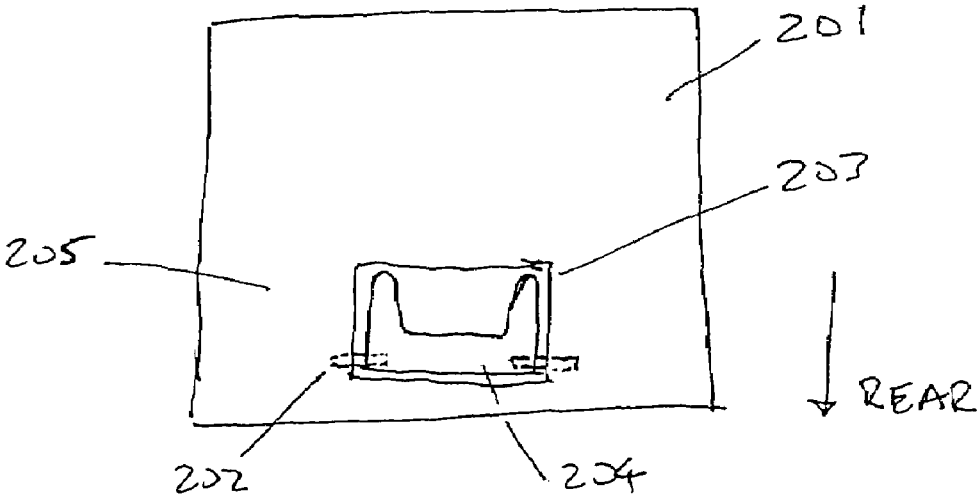
FIG. 2 is a bottom view of a preferred embodiment of the invention.
Figure 3:
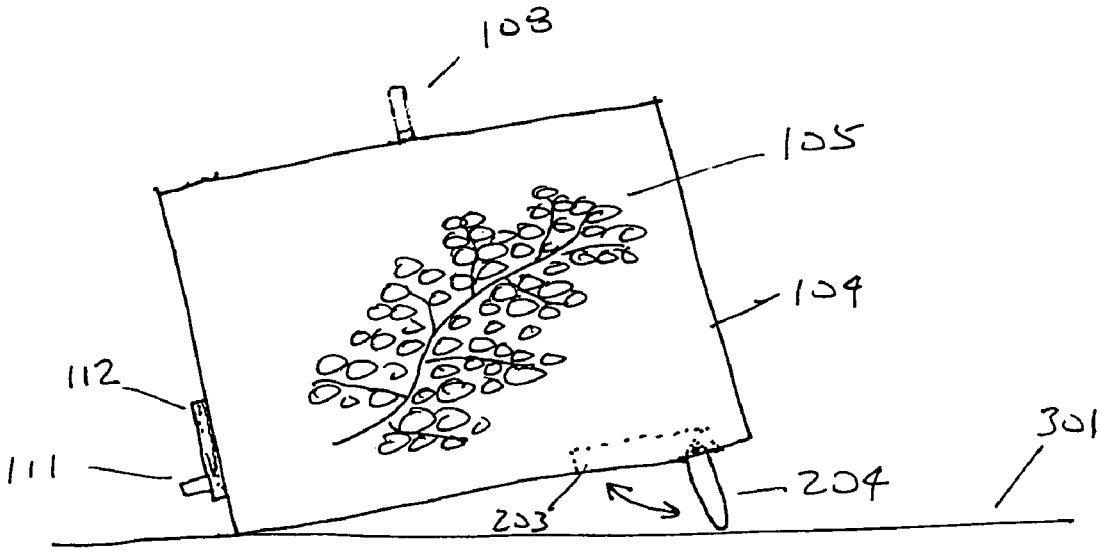
FIG. 3 is a side view of a preferred embodiment of the invention.

Referring to FIG. 2 and FIG. 3, retractable stand system 205 is shown. Retractable stand system 205 includes stand 204 and pins 202. Bottom surface 201 includes a cavity 203, for receiving retractable stand system 205. In its retracted position, retractable stand system 205 is completely recessed into cavity 203 and bottom surface 201 is flush with receiving surface 301. In the deployed position, retractable stand system 205 elevates the rear portion of housing 101 to encourage the efficient emptying of any beverage container included in housing 101. Alternatively, other systems for selectively raising the rear of housing 101 may be utilized, such as retractable legs extending from rear surface 403 and the like.

There are many advantages associated with the present invention. These advantages include providing a secure, insulated, aesthetically appealing container for housing and protecting a beverage filled container, and providing a system for readily, and selectively, encouraging the efficient dispensing of beverage as the liquid level of an included beverage filled container lowers.

The preceding discussion is provided for example only. Other variations of the claimed inventive concepts will be obvious to those skilled in the art. Adaptation or incorporation of known alternative devices and materials, present and future, is also contemplated. The intended scope of the invention is defined by the following claims.

I claim:

1. A beverage dispensing system comprising:

a. a housing, said housing including means for allowing the placement and removal of a beverage filled container within said housing, and an opening through an exterior of said housing for receiving a spout integral to said beverage filled container; and b. means for selectively raising a rear of said housing to encourage complete emptying of said beverage filled container, said means integral to, and retractable within, said housing and wherein said means for selectively raising a rear of said housing comprises a retractable stand, said stand selectively positionable between a first position, said first position substantially recessed within said housing, and a second position, said second position extended from said housing such that said rear of said housing is raised with respect to a front of said housing.

2. A beverage dispensing system comprising:

a. a housing, said housing including means for allowing the placement and removal of a beverage filled container within said housing, an opening through an exterior of said housing for receiving a spout integral to said beverage filled container, and said housing adapted to receive an ornamentation;

b. means for selectively raising a rear of said housing to encourage complete emptying of said beverage filled container, said means integral to said housing and wherein said means for selectively raising a rear of said housing comprises a retractable stand, said stand selectively positionable between a first position, said first position substantially recessed within said housing, and a second position, said second position extended from said housing such that said rear of said housing is raised with respect to a front of said housing;

c. means for securing said spout to a front of said housing and partially occluding said opening through said housing d. means for removably labeling said housing with a content of said beverage filled container.

* * * * *